US006341431B1

(12) United States Patent
Noda

(10) Patent No.: US 6,341,431 B1
(45) Date of Patent: Jan. 29, 2002

(54) CONTAINER CENTRIFUGAL DRYING DEVICE

(75) Inventor: Michlo Noda, Mie-ken (JP)

(73) Assignee: Misuzu Koki Company Limited, Mie-ken (JP)

( * ) Notice: Subject to any disclaimer, the term of this patent is extended or adjusted under 35 U.S.C. 154(b) by 0 days.

(21) Appl. No.: 09/852,769

(22) Filed: May 11, 2001

(30) Foreign Application Priority Data

May 11, 2000 (JP) ..... 2000-138854

(51) Int. Cl.[7] ..... F26B 17/30
(52) U.S. Cl. ..... 34/58; 34/69; 34/236
(58) Field of Search ..... 34/58, 59, 60, 34/69, 236; 209/60, 148, 199; 99/483

(56) References Cited

U.S. PATENT DOCUMENTS 1,889,761 A * 12/1932 Schlesinger ..... 34/58
3,152,875 A * 10/1964 Davis et al. ..... 34/58
3,659,550 A * 5/1972 Fulton ..... 118/6
3,688,906 A * 9/1972 Ferrara ..... 210/152
4,189,850 A * 2/1980 Dieterich et al. ..... 34/58
4,412,390 A * 11/1983 Grant ..... 34/58
5,054,209 A * 10/1991 Koff ..... 34/58
5,435,075 A * 7/1995 Shiraishi et al. ..... 34/58
6,125,551 A * 10/2000 Bushong et al. ..... 34/318
6,269,548 B1 * 8/2001 Shinozaki et al. ..... 34/58
6,282,809 B1 * 9/2001 Sunde ..... 34/59

FOREIGN PATENT DOCUMENTS

JP 56-114395 9/1981
JP 61-20471 6/1986

* cited by examiner

*Primary Examiner*—Ira S. Lazarus
*Assistant Examiner*—K. B. Rinehart
(74) *Attorney, Agent, or Firm*—Foley & Lardner

(57) ABSTRACT

In a conventional container centrifugal drying device, a problem exists in that a member is easily corroded by a detergent in use for a long period, and a rotating portion is heavy in weight so that energy at accelerating and decelerating times is large. A container centrifugal drying device has a container centrifugal drier A including a turntable 1 for arranging stacked containers C thereon after a washing process; plural columns 2 vertically arranged in an upper portion of the turntable 1; an upper plate 3 for connecting the plural columns 2 to each other in their upper portions; a clamp portion 4 rotatably arranged in the columns 2 and fixing a corner portion of the containers so as to be freely opened and closed while the stacked containers C are centered; a drive motor 5 for rotating the turntable 1, the column 2, the upper plate 3 and the clamp portion 4; and a cylinder 6 for clamp opening-closing for opening and closing the clamp portion 4; wherein at least the columns 2 and the clamp portion 4 are constructed of a carbon system composite material.

3 Claims, 3 Drawing Sheets

CONTAINER CENTRIFUGAL DRYING DEVICE

BACKGROUND OF THE INVENTION

1. Field of the Invention

This invention relates to a container centrifugal drying device, and more particularly, relates to a container centrifugal drying device of a food container used in a food factory of bread, etc.

2. Description of the Background Art

A food container used in a food factory of bread, etc. is also called a distribution container or a container, and is formed by a hard synthetic resin material, etc. A hot air drier of a tunnel system chain conveyer type and a device for drying the container by rotating the container are conventionally known as the drying device of this food container.

In the container centrifugal drying device for drying the container by rotating the container, a centrifugal dehydration drying device of a solid container (Japanese Laid-Open (Kokai) Utility Model No. 56-114395), and a container centrifugal drying device (Japanese Published (Kokoku) Utility Model No. 61-20471 (prior art 1) are devised by the inventors of this application. The centrifugal dehydration drying device of the solid container is constructed by a hollow rotating body inscribed in the solid container and divided in a suitable position of a circumferential face and able to be freely opened and closed, an opening-closing means for opening and closing the hollow rotating body, and a hanging-stopping means for restraining the hollow rotating body. In the container centrifugal drying device, a suitable number of rotating tubes are vertically arranged in a rotating board on which a stacked container is arranged. A clamp for gripping a corner portion of the stacked container so as to be freely opened and closed is fixed to the rotating tubes by a fixing link. A rotatable swash plate is raised and lowered through a cam follower fixed to an elevating frame able to be freely raised and lowered. The swash plate and the above rotating tubes are connected to each other through a connecting link having a connecting plate and a bent portion.

However, in the prior art 1, the number of parts of the entire container centrifugal drying device is large, and a clamp opening-closing mechanism of the container is complicated. Therefore, a problem exists in that working efficiency is bad and it is difficult to make works at maintenance and checking times, etc. Further, a problem also exists in that a member is easily corroded by various kinds of detergents such as a washing liquid left in the container, etc.

Further, since the drying device is relatively heavy in weight, a problem exists in that the inertia amount of a rotating portion is increased so that energy is required at accelerating and decelerating times of the rotating portion.

Furthermore, a projecting portion (clogs) parallel to a longitudinal direction of the container on its bottom face side is arranged. Therefore, when the container is directed to the longitudinal direction as it is, the projecting portion projected from the bottom face hits against the container at a feeding time to the container centrifugal drier so that no container can be placed onto a turntable. Accordingly, the container is fed to the container centrifugal drier in a transversal direction seen from a plane. Therefore, both end faces for clamping the container become longitudinal end faces so that the length of an upper plate portion from its rotation center becomes longer than that in a transversal direction, and the inertia amount of rotation is increased.

SUMMARY OF THE INVENTION

To solve this problem, the present invention proposes a container centrifugal drying device characterized in that the container centrifugal drying device has a container centrifugal drier comprising a turntable for arranging stacked containers thereon after a washing process; plural columns vertically arranged in an upper portion of the turntable; an upper plate for connecting the plural columns to each other in their upper portions; a clamp portion rotatably arranged in the columns and fixing a corner portion of the containers so as to be freely opened and closed while the stacked containers are centered; a drive motor for rotating the turntable, the columns, the upper plate and the clamp portion; and a cylinder for clamp opening-closing for opening and closing the clamp portion; wherein at least the columns and the clamp portion are constructed by a carbon system composite material.

The present invention also proposes a container centrifugal drying device characterized in that the container centrifugal drying device has a container centrifugal drier comprising a turntable for arranging stacked containers thereon after a washing process; plural columns vertically arranged in an upper portion of the turntable; an upper plate for connecting the plural columns to each other in their upper portions; a clamp portion rotatably arranged in the columns and fixing a corner portion of the containers so as to be freely opened and closed while the stacked containers are centered; a drive motor for rotating the turntable, the columns, the upper plate and the clamp portion; and a cylinder-for clamp opening-closing for opening and closing the clamp portion; wherein the cylinder for clamp opening-closing is connected to plural yokes for clamp opening-closing arranged upward and downward in the columns through a push pull rod arranged in a vertical direction at a rotation center of the turntable and passing a central portion of an upper shaft of the turntable, and a rotary coupling transmitting no rotation of the drive motor and transmitting only thrust of the cylinder for clamp opening-closing; a link mechanism for opening and closing the clamp portion is arranged in each of-the yokes for clamp opening-closing; and at least the columns and the clamp portion are constructed by a carbon system composite material.

The present invention further proposes a container centrifugal drying device characterized in that the container centrifugal drying device has a container centrifugal drier comprising a turntable for arranging stacked containers thereon after a washing process; plural columns vertically arranged in an upper portion of the turntable; an upper plate for connecting the plural columns to each other in their upper portions; a clamp portion rotatably arranged in the columns and fixing a corner portion of the containers so as to be freely opened and closed while the stacked containers are centered; a drive motor for rotating the turntable, the columns, the upper plate and the clamp portion; and a cylinder for clamp opening-closing for opening and closing the clamp portion; wherein at least the columns and the clamp portion are constructed by a carbon system composite material, and a detent type dog mechanism having at least three dogs is arranged in a container supply-discharge device for supplying and discharging the stacked and aligned containers to the container centrifugal drier.

DESCRIPTION OF THE PREFERRED EMBODIMENTS

Figure 1:
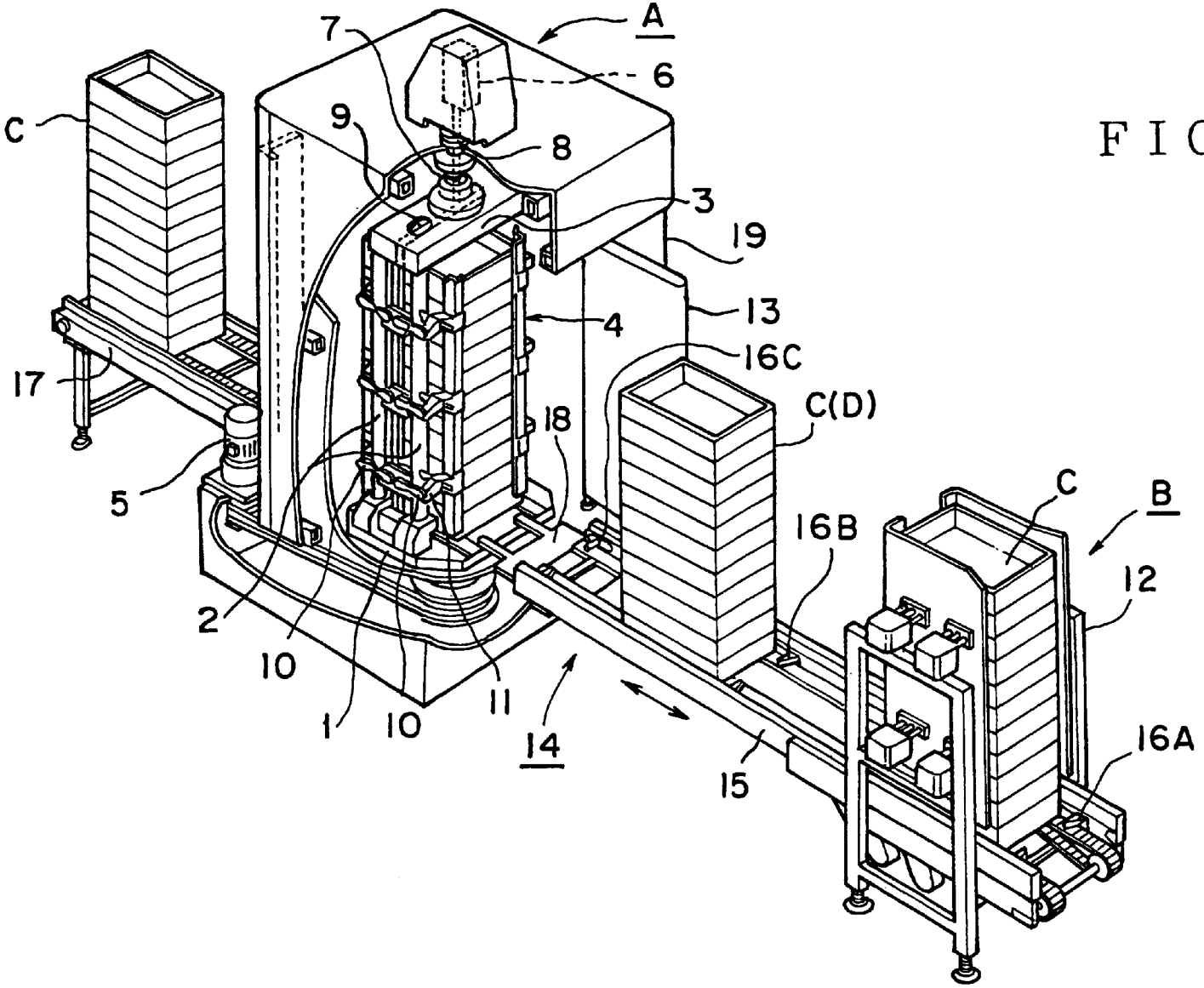
FIG. 1 is a perspective view for entirely explaining a container centrifugal drying device showing an embodiment mode of this invention.
Figure 2:
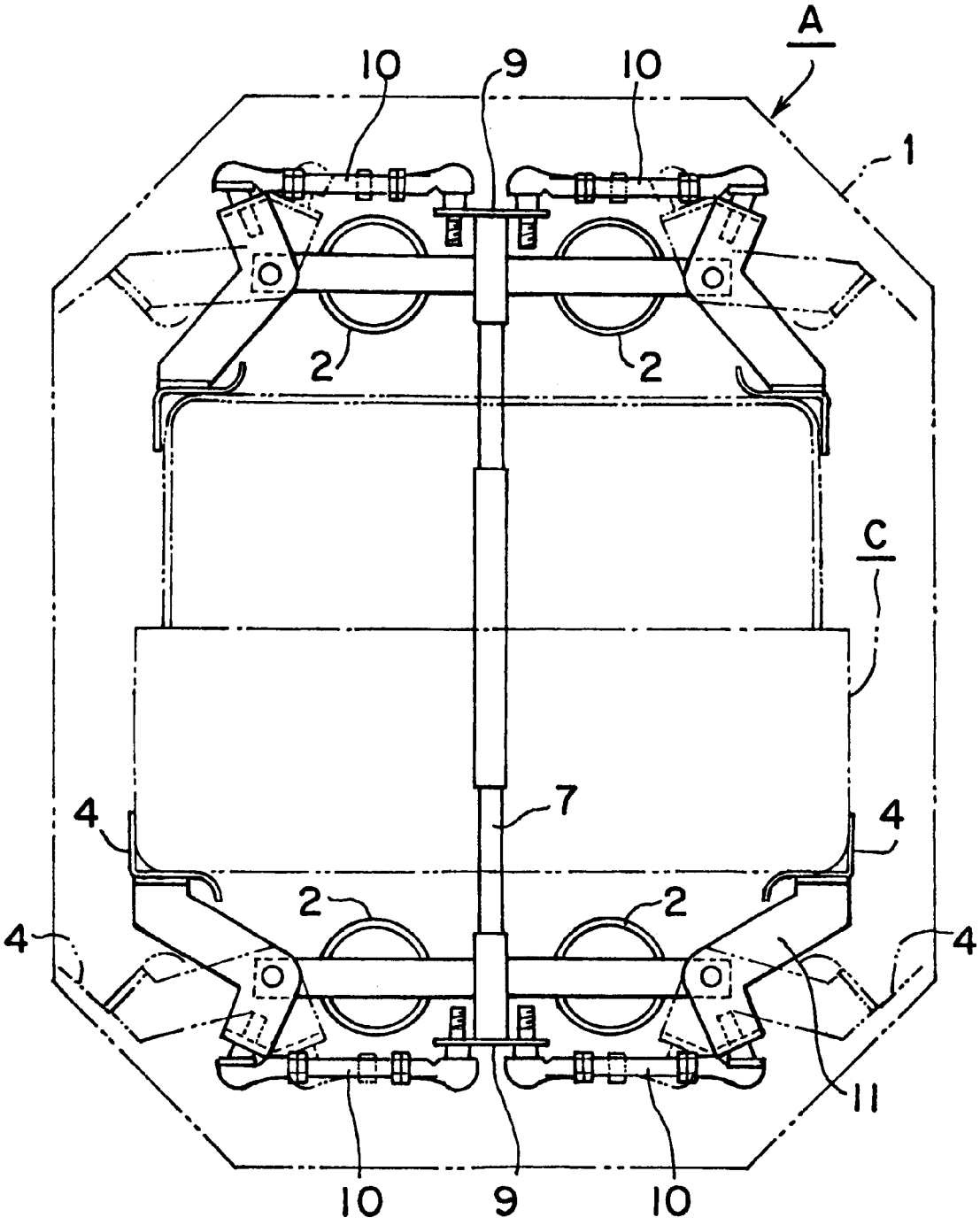
FIG. 2 is a plan view for explaining the interior of a container centrifugal drier.
Figure 3:
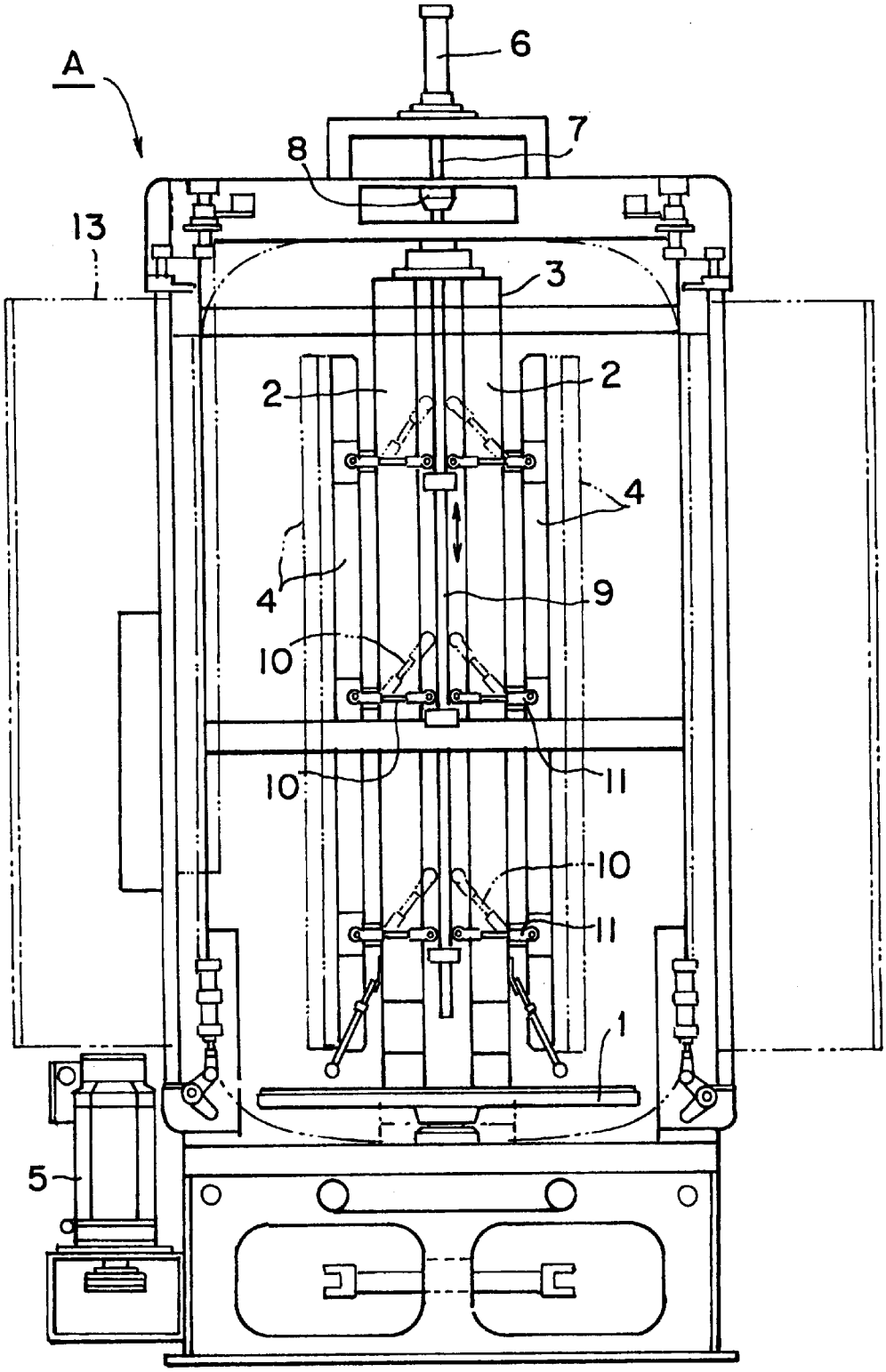
FIG. 3 is a front view for explaining the container centrifugal drier.

A container centrifugal drying device in accordance with an embodiment mode of this invention will be explained on the basis of FIGS. 1 to 3. FIG. 1 is a perspective view for entirely explaining the container centrifugal drying device showing the embodiment mode of this invention. FIG. 2 is a plan view for explaining the interior of a container centrifugal drier. FIG. 3 is a front view for explaining the container centrifugal drier. In the plan view for explaining the interior of the container centrifugal drier in FIG. 2, a container C is divided into halves and is drawn with respect to the using case of a square container seen from a plane and the using case of a rectangular container from the plane.

The container centrifugal drying device of this invention is constructed by a container centrifugal drier A for rotating, centrifuging and drying the stacked container C, and a container supply-discharge device B for feeding and discharging the stacked container C from the container centrifugal drier A.

The container C is washed by warm water, a washing liquid, etc. in an unillustrated washer. Thereafter, a suitable number of containers C are stacked and are conveyed by a supply conveyer on an upstream side until an aligning device 12. The fed and stacked containers C are aligned by the aligning device 12. The stacked and aligned containers C are fed into the container centrifugal drier A by a pusher portion 14 of the container supply-discharge device B. The pusher portion 14 has three dog mechanisms 16 of a detent type arranged on a conveying path 15 constructed by two parallel pusher pipes. The stacked and aligned containers C located in the aligning device 12 are pushed out by a three dog 16A arranged on an upstream 5 side of the aligning device 12 until a standby position D of the conveying path 15. When the previous containers C dried within the container centrifugal drier A are fed out of the container centrifugal drier A and the interior of the container centrifugal drier A becomes empty, the containers B fed into the standby position D of the conveying path 15 push out the containers C by a second dog 16B until a position above a turntable 1 within the container centrifugal drier A. A first dog 16C located on the upstream side of the container centrifugal drier A is a dog for discharge which sends-out the containers C dried within the container centrifugal drier A onto a discharge conveyer 17 on a downstream side. A plate-shaped bridge 18 of a semi-lift type able to be horizontally and vertically changed by an air cylinder, etc. is arranged on a lowermost stream side of the pusher portion 14. The bridge 18 has two parallel bridge portions.

The container centrifugal drier A has the rotatable turntable 1, plural columns 2, an upper plate 3, a clamp portion 4, a drive motor 5 and a cylinder 6 for clamp opening-closing. The stacked containers B after a washing process are approximately arranged at the center of rotation on the turntable 1. The turntable 1 has a polygonal shape seen from a plane, and has an octagonal shape seen from the plane in this embodiment. The plural columns 2 are fixed to an upper portion of the turntable 1, and are vertically arranged. The upper plate 3 connects the plural columns 2 in their upper portions. While the stacked containers B rotatably arranged in the columns 2 are centered, the clamp portion 4 fixes a corner portion of the containers B so as to be freely opened and closed. The drive motor 5 rotates the turntable 1, the columns 2, the upper plate 3 and the clamp portion 4. The cylinder 6 for clamp opening-closing opens and closes the clamp portion 4. The container centrifugal drier A has a double hinged door portion 13 able to be freely opened and closed on each of a supply side and a discharge side of an external mounting portion 19. The container centrifugal drier A attains a closing state by closing the double hinged door portion 13.

The turntable 1 is connected to the drive motor 5 in a lower portion thereof by a V-belt. An inverter and a motor of a regenerative braking type are used in the drive motor 5. The clamp portion 4 is constructed by four members which have internal perpendicular portions for clamping four corners of the stacked containers C and are arranged in a vertical direction. In this embodiment mode, these members are respectively connected to three upper and lower clamp arms 11. In this embodiment mode, the columns 2 are arranged in opposite positions at the same distance from the rotation center of the turntable 1 every two columns.

At least the column 2 and the clamp portion 4 in members of the container centrifugal drier A are constructed by a carbon system composite material to strengthen corrosion-resistant property with respect to various kinds of detergents such as alkaline detergents, etc. left in the containers B conveyed and placed on the turntable 1 even after washing. An inner wall surface of the container centrifugal drier A is processed by a gel coat finishing FRP resin material, and a corner portion is formed in a curving shape.

The cylinder 6 for clamp opening-closing is connected to plural yokes 9 for clamp opening-closing arranged in the vertical direction between the columns 2 through a push pull rod 7 and a rotary coupling 8. The push pull rod 7 is arranged in the vertical direction at the rotation center of the turntable 1, and passes a central portion of an upper shaft of the turntable 1. The rotary coupling 8 does not transmit rotation of the drive motor 5, and transmits only thrust of the cylinder 6 for clamp opening-closing.

The yokes 9 for clamp opening-closing are arranged in the vertical direction between the respective plural columns 2, and are formed in a portal shape together with a portion horizontally arranged in the upper plate 3.

Plural connecting rods 10 as link mechanisms are arranged upward, downward, leftward and rightward in the yokes 9 for clamp opening-closing vertically arranged in positions opposed to each other. In this embodiment mode, three connecting rods 10 are arranged. The connecting rods 10 are respectively connected to the clamp arms 11. The respective clamp arms 11 are connected to the four clamp portions 4 having the internal perpendicular portions for clamping the four corners of the stacked containers B.

The connecting rods 10 are rotatably connected to the yokes 9 for clamp opening-closing. The connecting rods 10 attain a horizontal state in a closing state in which the clamp portion 4 clamps the four corners of the stacked containers B. The connecting rods 10 attain an unfolded fan state in an opening state of the clamp portion 4.

An operation of the container centrifugal drying device of this invention will next be explained.

A container C used in the embodiment mode of this invention is formed in a rectangular shape seen from a plane, and is washed by warm water, a washing liquid, etc. in an unillustrated washer. Thereafter, a suitable number of containers are stacked and are conveyed by a supply conveyer on an upstream side until the aligning device 12, and are stacked and aligned by the aligning device 12. At this time, end faces of the containers C in a longitudinal direction are located in a forward-backward direction, and both side faces of the containers C in a transversal direction are located leftward and rightward. In this state, the containers C stacked and aligned within the aligning device 12 are pushed out by the third dog 16A of the pusher portion 14 of the container supply-discharge device .B until the standby position D of the conveying path 15. At this time, the second dog 16B and the first dog 16C are simultaneously operated, and the second dog 16B sends the containers C located in the standby position D into the container centrifugal drier A. The first dog 16C pushes out the containers C located within the container centrifugal drier A onto the discharge conveyer 17, and respectively simultaneously moves the containers C. These dogs are sequentially similarly operated. The bridge 18 arranged in a lowermost stream of the conveying path 15 is vertically located in a normal state, and is set to be horizontal in accordance with the conveyed containers C. The bridge 18 horizontally connects the pusher portion 13 and the turntable 1 of the container centrifugal drier A. When the stacked containers C enters the container centrifugal drier A from end face sides of the containers C in the longitudinal direction, both the double hinged door portions 19 arranged on the supply and discharge sides in the external mounting portion 19 are closed so that the closing state is set.

The containers C fed into the container centrifugal drier A are placed near the rotation center of the turntable 1. Next, the cylinder 6 for clamp opening-closing is operated so that the push pull rod 7 vertically arranged at the rotation center of the turntable 1 and passing a central portion of the upper shaft of the turntable 1 is lowered. The push pull rod 7 lowers two yokes 9 for clamp opening-closing arranged in a portal shape in the vertical direction through the rotary coupling 9 which does not transmit rotation of the drive motor 5, and transmits only thrust of the cylinder 6 for clamp opening-closing.

When the two opposite yokes 9 for clamp opening-closing are lowered, unfolded fan-shaped upper end connecting portion of the left-hand and right-hand connecting rods 10 as three upper and lower link mechanisms are lowered and rotated with respect to the yokes 9 for clamp opening-closing, and are located in a straight shape in a horizontal state. The other end portions of the connecting rods 10 are respectively connected to the clamp arms 11. The respective clamp arms 11 rotate the four clamp portions 4 by the straight horizontal state of the connecting rods 10, and fix the containers C such that the four corner portions of the containers C are nipped from an outer side, and no containers C are moved at the rotation center of the turntable 1. Both end faces of the containers C in the transversal direction are set to a clamping state of the containers C, and the upper plate 3 is relatively short from the rotation center.

At this time, the containers C are pressed from an upper portion by the push pull rod 7 using downward pressure of the cylinder 6 for clamp opening-closing, and attain the straight horizontal state together with the connecting rods 10 adjacent to each other. Thus, the containers C can reliably resist centrifugal force generated by rotation. In another embodiment mode, the plural connecting rods 10 are hierarchically arranged so that the connecting rods resist centrifugal rotation force as a fail safe structure and safety is improved.

When the containers C are nipped and supported by the clamp portion 4, the drive motor 5 is operated and rotation force is transmitted to the turntable 1 by the V-belt so that the turntable 1 is rotated. At this time, no rotation force is transmitted to the cylinder 6 for clamp opening-closing by an action of the rotary coupling 8 even when the turntable 1 is rotated.

A rotation number of the turntable 1 is accelerated by the drive motor 5 until a constant rotation number, and the containers C are centrifugally dried (dehydrated) by rotation centrifugal force. Thereafter, the drive motor 5 is stopped in a constant position by regenerative braking. At this braking time, a main member of the container centrifugal drier A is constructed by a carbon system composite material so that the main member is made light in weight in comparison with the conventional case. Therefore, the rotation inertia moment of a rotating device can be greatly reduced. Further, an inner wall surface of the container centrifugal drier A is processed by a gel coat finishing FRP resin material, and a corner portion is formed in a curving shape. Therefore, rubbish, dust and a waterdrop are not easily collected in the corner portion, and a discharge time of the waterdrop is increased so that a sanitary state is improved.

An inverter and a motor of a regenerative braking type are used in the drive motor 5. Therefore, indexing accuracy of the turntable 1 with respect to 180 degrees is improved, and indexing can be easily performed. Further, drive power consumption can be very saved by collecting electric power at a regenerative braking time of the container centrifugal drier A.

The detent type dog mechanism is arranged in the container supply-discharge device B so that the containers C within the container centrifugal drier A are discharged onto a side of the discharge conveyer 17. Simultaneously, the containers C in the standby position are sent into a position of the rotation center of the turntable 1 within the container centrifugal drier A. Further, the containers C stacked within the aligning device 12 can be pushed out until the standby position.

Since the turntable 1 is formed in a polygonal shape seen from a plane, the turntable 1 can be manufactured by stainless using press working. Accordingly, manufacture cost of the turntable 1 can be reduced.

The main material of the container centrifugal drier is constructed by a member having a high corrosion-resistant property with respect to various kinds of detergents so that corrosion of the device member can be prevented. Accordingly, life of the container centrifugal drying device can be extended.

Since the container centrifugal drier is made light in weight, the container centrifugal drier is more easily regeneratively braked. Further, drive power consumption can be very saved by collecting electric power at a regenerative braking time. Thus, running cost of the drying device can be reduced by half. Further, processing ability required to dry the containers is improved by shortening accelerating and decelerating times of the rotation of the turntable in the container centrifugal drier.

Since the detent type dog mechanism is arranged in the container supply-discharge device, the length of a conveyer for supply can be greatly shortened so that an arrangement area can be reduced.

Furthermore, when the containers are sent into the container centrifugal rotation drier, the containers can be sent such that end faces of the containers in the longitudinal direction seen from a plane are directed to a forward-backward direction. Therefore, both the end faces for clamping the containers are set to both end faces in a transversal direction so that the length of an upper plate portion from the rotation center is shortened. Accordingly, rotation inertia amount can be reduced, and drive power consumption can be saved.

What is claimed is:

1. A container centrifugal drying device characterized in that the container centrifugal drying device has a container centrifugal drier comprising a turntable for arranging stacked containers thereon after a washing process; plural columns vertically arranged in an upper portion of the turntable; an upper plate for connecting the plural columns to each other in an upper portion of the columns; a clamp portion rotatably arranged in the columns and fixing a corner portion of the containers so as to be freely opened and closed while the stacked containers are centered; a drive motor for rotating the turntable, the columns, the upper plate and the clamp portion; and a cylinder for clamp opening-closing for opening and closing the clamp portion;

wherein at least the columns and the clamp portion are constructed of a carbon system composite material.

2. A container centrifugal drying device characterized in that the container centrifugal drying device has a container centrifugal drier comprising a turntable for arranging stacked containers thereon after a washing process; plural columns vertically arranged in an upper portion of the turntable; an upper plate for connecting the plural columns to each other in an upper portion of the columns; a clamp portion rotatably arranged in the columns and fixing a corner portion of the containers so as to be freely opened and closed while the stacked containers are centered; a-drive motor for rotating the turntable, the columns, the upper plate and the clamp portion; and a cylinder for clamp opening-closing for opening and closing the clamp portion; wherein the cylinder for clamp opening-closing is connected to plural yokes for clamp opening-closing arranged upward and downward in the columns through a push pull rod arranged in a vertical direction at a rotation center of the turntable and passing a central portion of an upper shaft of the turntable, and a rotary coupling transmitting no rotation of the drive motor and transmitting only thrust of the cylinder for clamp opening-closing; a link mechanism for opening and closing the clamp portion is arranged in each of the yokes for clamp opening-closing; and at least the columns and the clamp portion are constructed of a carbon system composite material.

3. A container centrifugal drying device characterized in that the container centrifugal drying device has a container centrifugal drier comprising a turntable for arranging stacked containers thereon after a washing process; plural columns vertically arranged in an upper portion of the turntable; an upper plate for connecting the plural columns to each other in an upper portion of the columns; clamp portion rotatably arranged in the columns and fixing a corner portion of the containers so as to be freely opened and closed while the stacked containers are centered; a drive motor for rotating the turntable, the columns, the upper plate and the clamp portion; and a cylinder for clamp opening-closing for opening and closing the clamp portion;

wherein at least the columns and the clamp portion are constructed of a carbon system composite material, and a detent type dog mechanism having at least three dogs is arranged in a container supply-discharge device for supplying and discharging the stacked and aligned containers to the container centrifugal drier.

* * * * *

UNITED STATES PATENT AND TRADEMARK OFFICE

CERTIFICATE OF CORRECTION

PATENT NO. : 6,341,431 B1
DATED : January 29, 2002
INVENTOR(S) : Michio Noda

It is certified that error appears in the above-identified patent and that said Letters Patent is hereby corrected as shown below:

Title page,
Item [75], should read as follows; -- [75] Inventor: Michio Noda, Mie-ken (JP) --

Signed and Sealed this

Tenth Day of September, 2002

*Attest:*

*Attesting Officer*

JAMES E. ROGAN
*Director of the United States Patent and Trademark Office*